US007893902B2

(12) United States Patent
Shie

(10) Patent No.: US 7,893,902 B2
(45) Date of Patent: Feb. 22, 2011

(54) LIQUID CRYSTAL DISPLAY HAVING VOLTAGE CHANGE CIRCUITS

(75) Inventor: De-Ching Shie, Miao-Li (TW)

(73) Assignee: Chimei Innolux Corporation, Miao-Li County (TW)

( * ) Notice: Subject to any disclaimer, the term of this patent is extended or adjusted under 35 U.S.C. 154(b) by 757 days.

(21) Appl. No.: 11/985,888

(22) Filed: Nov. 19, 2007

(65) Prior Publication Data

US 2008/0117199 A1 May 22, 2008

(30) Foreign Application Priority Data

Nov. 17, 2006 (CN) ..... 2006 1 0156919

(51) Int. Cl.
*G09G 3/36* (2006.01)

(52) U.S. Cl. ..... 345/87; 345/212

(58) Field of Classification Search ..... 345/87, 345/212

See application file for complete search history.

(56) References Cited

U.S. PATENT DOCUMENTS 6,342,782 B1 * 1/2002 Yamaguchi et al. ..... 323/369
6,583,476 B1 6/2003 Miller et al.
7,474,306 B2 * 1/2009 Doi et al. ..... 345/206

FOREIGN PATENT DOCUMENTS

CN 1293764 A 5/2001
CN 1361910 A 7/2002
CN 1387633 A 12/2002

* cited by examiner

*Primary Examiner*—Richard Hjerpe
*Assistant Examiner*—Troy Dalrymple
(74) *Attorney, Agent, or Firm*—Wei Te Chung

(57) ABSTRACT

An exemplary LCD (2) includes a glass substrate (29) having a display area (21); driving integrated circuits (ICs) (210) disposed at two adjacent sides of the glass substrate for providing image signals to the display area; first and second voltage change circuits (216, 217); and a flexible printed circuit board (FPCB) connected to the glass substrate at a corner for providing operating voltages to the driving ICs. The driving IC includes first reference voltage pins, second reference voltage pins, first voltage following pins, second voltage following pins, and an operating voltage input pin. The first voltage change circuits are respectively connected between the first reference voltage pins and the corresponding first voltage following pins. The second voltage change circuits are respectively connected between the second reference voltage pins and the corresponding second voltage following pins.

20 Claims, 3 Drawing Sheets

LIQUID CRYSTAL DISPLAY HAVING VOLTAGE CHANGE CIRCUITS

FIELD OF THE INVENTION

The present invention relates to liquid crystal displays (LCDs), and particularly to an LCD having voltage change circuits.

GENERAL BACKGROUND

An LCD has the advantages of portability, low power consumption, and low radiation. LCDs have been widely used in various portable information products, such as notebooks, personal digital assistants (PDAs), video cameras and the like. Furthermore, the LCD is considered by many to have the potential to completely replace CRT (cathode ray tube) monitors and televisions.

FIG. 4 is a block diagram including abbreviated circuitry of a typical LCD 1. The LCD 1 includes a glass substrate 19 having a main display area 11, a number of first conducting lines 119 extending from two adjacent sides of the display area 11 at two adjacent side portions of the glass substrate 19, a number of driving integrated circuits (ICs) 10 disposed at the two adjacent side portions of the glass substrate 19 according to the first conducting lines 119, and a flexible printed circuit board (FPCB) 12 connected to a corner portion of the glass substrate 19 for providing operating voltages to the driving ICs 10. Only two driving ICs 10 are illustrated; and unless the context indicates otherwise, in the following description it will be assumed that there are two driving ICs 10.

Each driving IC 10 includes a number of first reference voltage pins 111, a number of second reference voltage pins 113, a number of first voltage following pins 110, a number of second voltage following pins 112, an operating voltage input pin 114 connected to the FPCB 12 for receiving at least one operating voltage, and a number of signal output pins 115 connected to the first conducting lines 119 respectively for providing image signals to the display area 11.

The first voltage following pins 110 are connected to the first reference voltage pins 111 respectively via a number of second conducting lines 117 on the glass substrate 19. The second voltage following pins 112 are connected to the second reference voltage pins 113 respectively via a number of third conducting lines 118 on the glass substrate 19.

When the operating voltages are provided to the operating voltage input pins 114 of the driving ICs 10 via the FPCB 12 from an external power supply (not shown), the driving ICs 10 work. Each driving IC 10 receives a first reference voltage and a second reference voltage respectively at the first reference voltage pins 111 and the second reference voltage pins 113. Then, the first reference voltage and the second reference voltage are provided to the first voltage following pins 110 and the second voltage following pins 112, respectively. The first reference voltage is a high level voltage. The second reference voltage is a low level voltage.

Normally, the first reference voltage and the second reference voltage are confirmed according to the operating voltages provided from the external power supply. The voltages at the first voltage following pins 111 and the second voltage following pins 113 are respectively equal to the first reference voltage and the second reference voltage. After the voltages at the first voltage following pins 111 and the second voltage following pins 113 are confirmed, the functions of the driving ICs 10 are defined according to the confirmed reference voltages.

In order to change a function of the driving ICs 10 or set a new function for the driving ICs 10, the voltages at the first voltage following pins 111 and the second voltage following pins 113 need to be adjusted or alternated. However, the layout of the second conducting lines 117 and the third conducting lines 118 on the glass substrate 19 of the LCD 1 does not support adjusting or alternating the voltages at the first voltage following pins 111 and the second voltage following pins 113. Thus if it is desired to change the functions of the driving ICs 10, the layout of the LCD 1 needs to be redesigned. Accordingly, the cost of manufacturing different versions or models of the LCD 1 is high.

It is desired to provide an LCD which can overcome the above-described deficiencies.

SUMMARY

In one preferred embodiment, an LCD includes a glass substrate having a display area; a plurality of driving integrated circuits (ICs) disposed at two adjacent sides of the glass substrate for providing image signals to the display area; a plurality of first voltage change circuits; a plurality of second voltage change circuits; and an FPCB connected to the glass substrate at a corner for providing operating voltages to the driving ICs. Each driving IC includes a plurality of first reference voltage pins, a plurality of second reference voltage pins, a plurality of first voltage following pins, a plurality of second voltage following pins, and an operating voltage input pin. The first voltage change circuits are respectively connected between the first reference voltage pins and the corresponding first voltage following pins for respectively changing a first reference voltage provided to the first voltage following pins. The second voltage change circuits respectively connected between the second reference voltage pins and the corresponding second voltage following pins for respectively changing a second reference voltage provided to the second voltage following pins.

Other novel features and advantages will become more apparent from the following detailed description when taken in conjunction with the accompanying drawings.

DETAILED DESCRIPTION OF PREFERRED EMBODIMENTS

Reference will now be made to the drawings to describe various embodiments of the present invention in detail.

Figure 1:
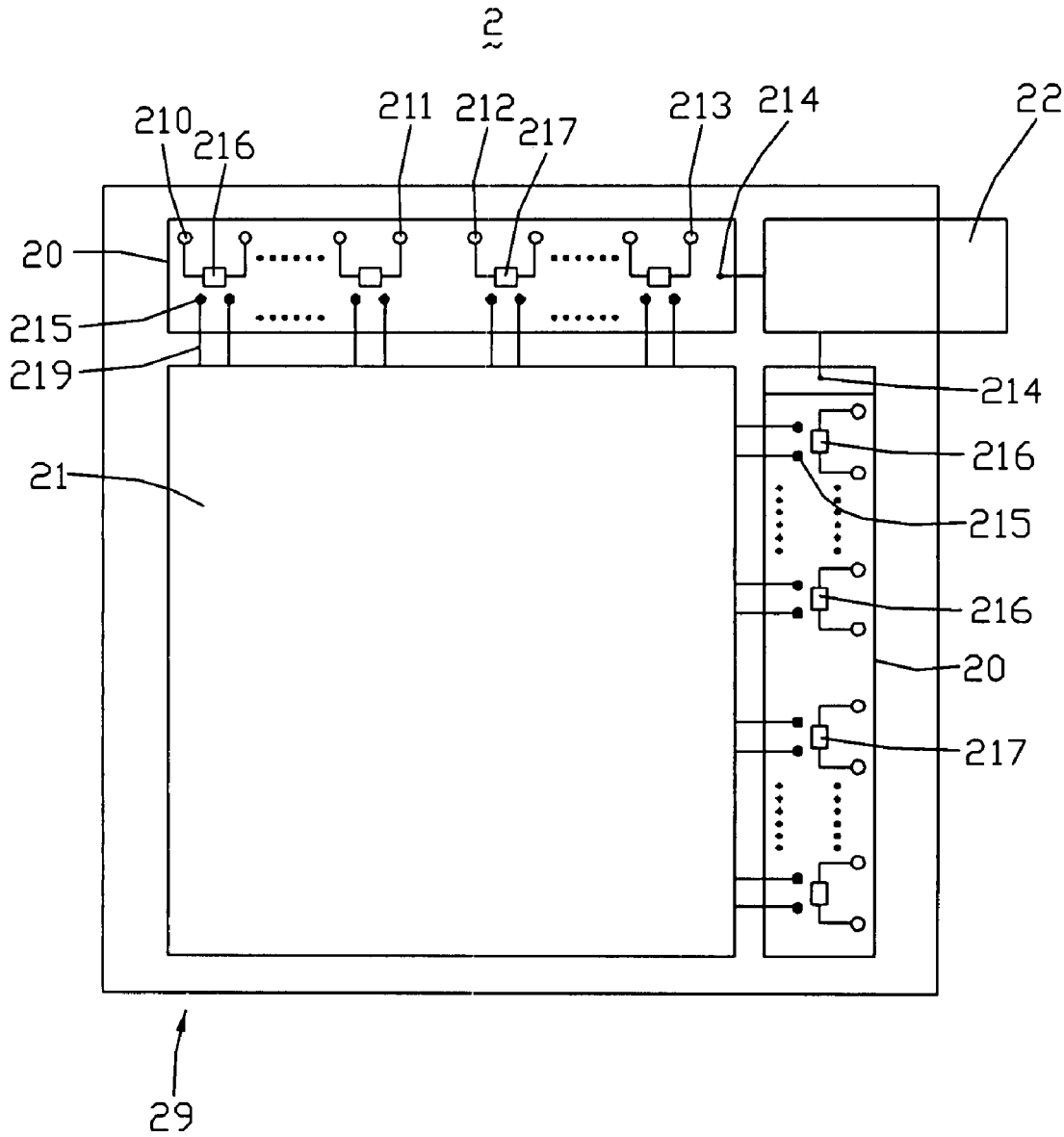
FIG. 1 is a block diagram including abbreviated circuitry of an LCD according to an exemplary embodiment of the present invention, the LCD including a plurality of first voltage change circuits and a plurality of second voltage change circuits.

FIG. 1 is a circuit diagram of an LCD according to an exemplary embodiment of the present invention. The LCD 2 includes a glass substrate 29 having a display area 21, a number of first conducting lines 219 extending from two adjacent sides of the display area 21 at two adjacent side portions of the glass substrate 29, a number of driving ICs 20 disposed at the two adjacent side portions of the glass substrate 29 according to the first conducting lines 219, a number of first voltage change circuits 216, a number of second voltage change circuits 217, and an FPCB 22 connected to a corner portion of the glass substrate 29 for providing operating voltages to the driving ICs 20. Only two driving ICs 20 are illustrated; and unless the context indicates otherwise, in the following description it will be assumed that there are two driving ICs 20.

Each driving IC 20 includes a number of first reference voltage pins 211, a number of second reference voltage pins 213, a number of first voltage following pins 210, a number of second voltage following pins 212, an operating voltage input pin 214 connected to the FPCB 22 for receiving at least one operating voltage, and a number of signal output pins 215 connected to the first conducting lines 219 respectively for providing image signals to the display area 21.

The first voltage following pins 210 are connected to the first reference voltage pins 211 respectively via the first voltage change circuits 216. The second voltage following pins 212 are connected to the second reference voltage pins 213 respectively via the second voltage change circuits 217.

Figure 2:
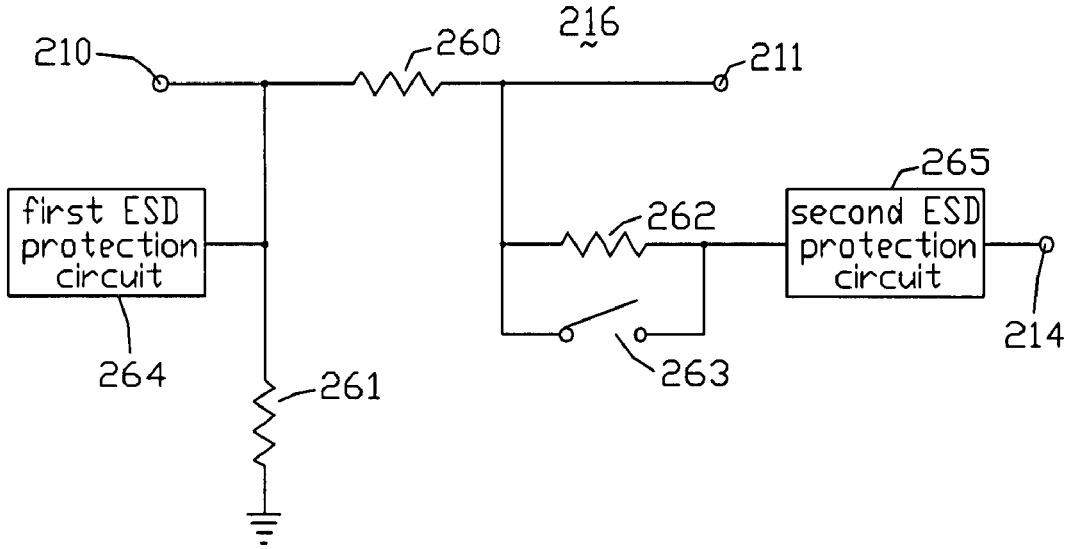
FIG. 2 is a circuit diagram of one first voltage change circuit of the LCD of FIG. 1.

Referring also to FIG. 2, each first voltage change circuit 216 includes a first resistor 260, a second resistor 261, a third resistor 262, a first switching unit 263, a first electrostatic discharge (ESD) protection circuit 264, and a second ESD protection circuit 265. The first and second ESD protection circuits 264, 265 are configured to prevent the corresponding driving IC 20 from being destroyed by a high level ESD voltage.

The first ESD protection circuit 264 is connected to the corresponding first voltage following pin 210. The first resistor 260 is connected between the corresponding first reference voltage pin 211 and the first voltage following pin 210. The second resistor 261 is connected between the first voltage following pin 210 and ground. The first reference voltage pin 211 is connected to the corresponding operating voltage input pin 214 via the third resistor 262 and the second ESD protection circuit 265 in series. The first switching unit 263 is connected in parallel with the third resistor 262. The first voltage change circuit 216 is formed on the glass substrate 29 by a semiconductor manufacturing method. The first resistor 260 is made of transparent metallic material such as indium tin oxide (ITO) or indium zinc oxide (IZO). A fuse part of the first resistor 260 is so narrow that the fuse part may melt when a high level ESD voltage is applied to the first resistor 260. The third resistor 262 is made of metallic material such as silicon or amorphous silicon. The third resistor 262 works normally even if the high level ESD voltage is applied to two terminals of the third resistor 262.

Figure 3:
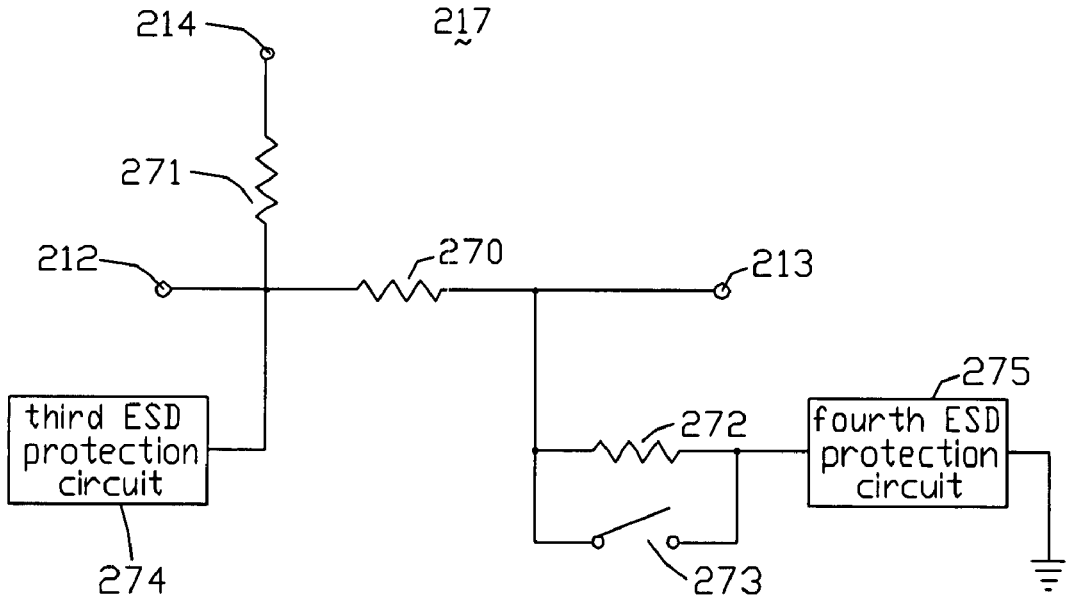
FIG. 3 is a circuit diagram of one second voltage change circuit of the LCD of FIG. 1.
Figure 4:
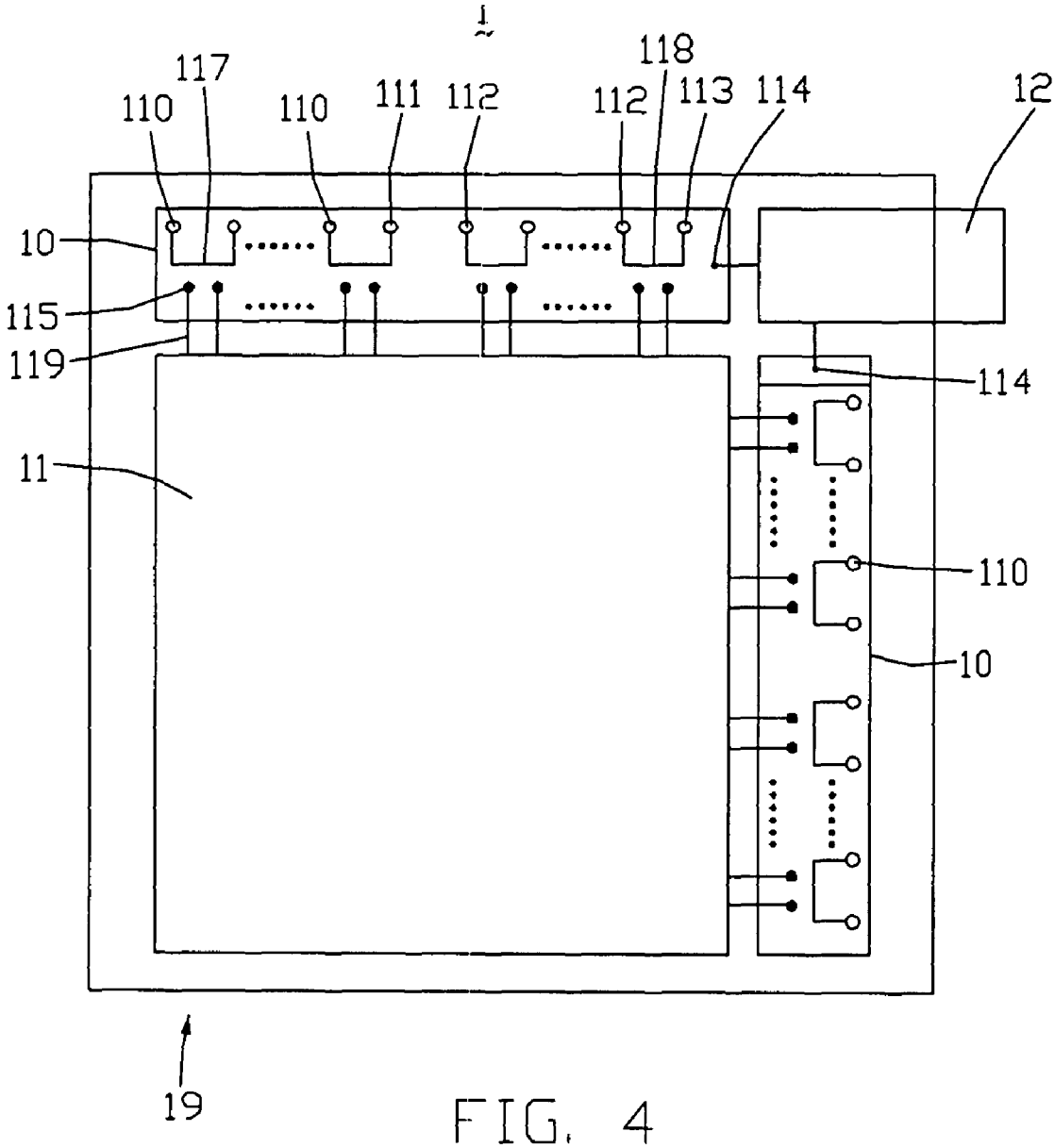
FIG. 4 (RELATED ART)
FIG. 4 is a block diagram including abbreviated circuitry of a conventional LCD.

Referring to FIG. 3, each second voltage change circuit 217 includes a fourth resistor 270, a fifth resistor 271, a sixth resistor 272, a second switching unit 273, a third ESD protection circuit 274, and a fourth ESD protection circuit 275. The third and fourth ESD protection circuits 264, 265 are configured to prevent the corresponding driving IC 20 from being destroyed by a high level ESD voltage.

The third ESD protection circuit 274 is connected to the corresponding second voltage following pin 212. The fourth resistor 270 is connected between the corresponding second reference voltage pin 213 and the second voltage following pin 212. The fifth resistor 271 is connected between the second voltage following pin 212 and the corresponding operating voltage input pin 214. The second reference voltage pin 213 is connected to ground via the sixth resistor 272 and the fourth ESD protection circuit 275 in series. The second switching unit 273 is connected in parallel with the sixth resistor 272. The second voltage change circuit 217 is formed on the glass substrate 29 by a semiconductor manufacturing method. The fourth resistor 270 is made of transparent metallic material such as indium tin oxide (ITO) or indium zinc oxide (IZO). A fuse part of the fourth resistor 270 is so narrow that the fuse part may melt when a high level ESD voltage is applied to the fourth resistor 270. The sixth resistor 272 is made of metallic material such as silicon or amorphous silicon. The sixth resistor 272 works normally even if the high level ESD voltage is applied to two terminals of the sixth resistor 272.

When the LCD 2 works normally, each first switching unit 263 and each second switching unit 273 in each driving IC 20 is turned on by the driving IC 20. A high level operating voltage is provided to the operating voltage input pin 214 from an external power supply (not shown). Thus a high level voltage regarded as the first reference voltage is provided to the first reference voltage pin 211 via the second ESD protection circuit 265 and the first switching unit 263 in series. The first reference voltage is provided to the first voltage following pin 210 via the first resistor 260. At the same time, a low level voltage regarded as a second reference voltage is provided to the second reference voltage pin 213 from ground via the fourth ESD protection circuit 275 and the second switching unit 273 in series. The second reference voltage is provided to the second voltage following pin 212 via the fourth resistor 270. Thus, in a normal mode, the voltages at the first voltage following pin 210 and the second voltage following pin 212 are respectively equal to a high level voltage and a low level voltage.

When functioning of one of the driving ICs 20 needs to be changed or alternated, in one example, two particular pairs of pins of the driving IC 20 are selected. For example, one of the first voltage following pins 210 and the corresponding first reference voltage pin 211 is selected, and one of the second voltage following pins 212 and the corresponding second reference voltage pin 213 is selected. The first switching unit 263 and the second switching unit 273 of the corresponding first and second voltage change circuits 216, 217 are turned off by the driving IC 20. An ESD voltage generator (not shown) is used to generate a high level ESD voltage such as 5000V, and provide the high level ESD voltage to the first and second reference voltage pins 211, 213 for a short moment. Thus the fuse parts of the first and fourth resistors 260, 270 are melted and cut off. Then, electrical charge generated when the high level ESD voltage is applied to the first and second reference voltage pins 211, 213 is discharged to ground via the third resistor 262 and the second ESD protection circuit 265 in series and via the sixth resistor 272 and the fourth ESD protection circuit 275 in series, respectively.

Since the first and fourth resistors 260, 270 are destroyed by the high level ESD voltage of the ESD generator, a low level voltage regarded as a first reference voltage is provided to the first reference voltage pin 210 from ground, and a high level voltage regarded as a second reference voltage is provided to the second reference voltage pin 212 via the operating voltage input pin 214. Thus, after the above-described burning process is performed, the voltages at the first voltage following pin 210 and the second voltage following pin 212 are respectively equal to a low level voltage and a high level voltage.

Because the LCD 2 includes a number of the first and second voltage change circuits 216, 217, any desired one or more pairs of pins of the driving IC 20 can be selected for altered functioning. By performing burning at the corresponding first and/or second voltage change circuits 216, 217, the voltage at each selected first voltage following pin 210 may be changed from the high level voltage to the low level voltage, and the voltage at each selected second voltage following pin 212 may be changed from the low level voltage to the high level voltage. Thus various desired functions of the driving ICs 210 can be changed without redesigning the layout of the LCD 2. Accordingly, the cost of manufacturing different versions or models of the LCD 2 can be reduced.

In an alternative embodiment, the first and second voltage change circuits 216, 217 may be integrated in the driving ICs 20. In such case, the layout of the glass substrate 19 is simplified.

It is to be understood, however, that even though numerous characteristics and advantages of preferred and exemplary embodiments have been set out in the foregoing description, together with details of the structures and functions of the embodiments, the disclosure is illustrative only; and that changes may be made in detail, especially in matters of arrangement of parts within the principles of the present invention to the full extent indicated by the broad general meaning of the terms in which the appended claims are expressed.

What is claimed is:

1. A liquid crystal display (LCD), comprising:

a glass substrate comprising a display area;

a plurality of driving integrated circuits (ICs) configured for providing image signals to the display area, each driving IC comprising a plurality of first reference voltage pins, a plurality of second reference voltage pins, a plurality of first voltage following pins, a plurality of second voltage following pins, and an operating voltage input pin;

a plurality of first voltage change circuits respectively connected between the first reference voltage pins and the first voltage following pins, each first voltage change circuit configured for conducting a first reference voltage from the first reference voltage pin to the first voltage following pin, and configured to be burned by an external apparatus such that the first reference voltage is thereafter changed to a different first reference voltage by the first voltage change circuit;

a plurality of second voltage change circuits respectively connected between the second reference voltage pins and the second voltage following pins, each second voltage change circuit configured for conducting a second reference voltage from the second reference voltage pin to the second voltage following pin, and configured to be burned by the external apparatus such that the second reference voltage is thereafter changed to a different second reference voltage by the second voltage change circuit; and a flexible printed circuit board (FPCB) connected to the glass substrate for providing operating voltages to the driving ICs.

2. The LCD as claimed in claim 1, wherein the first reference voltage pins are configured for providing a high level voltage as the first reference voltage to the corresponding first voltage following pins.

3. The LCD as claimed in claim 1, wherein the second reference voltage pins are configured for providing a low level voltage as the second reference voltage to the corresponding second voltage following pins.

4. The LCD as claimed in claim 1, wherein each first voltage change circuit comprises:

a first resistor connected between the first reference voltage pin and the first voltage following pin; and a second resistor connected between the first voltage following pin and ground.

5. The LCD as claimed in claim 4, wherein the first resistor comprises a fuse part configured to melt when a high level electrostatic discharge (ESD) voltage is applied to the first resistor.

6. The LCD as claimed in claim 5, wherein the first resistor is made of indium tin oxide (ITO).

7. The LCD as claimed in claim 5, wherein the first resistor is made of indium zinc oxide (IZO).

8. The LCD as claimed in claim 4, wherein the first voltage change circuit further comprises a first ESD protection circuit connected to the first voltage following pin.

9. The LCD as claimed in claim 8, wherein the first voltage change circuit further comprises a first switching unit, a third resistor, and a second ESD protection circuit, the first reference voltage pin being connected to the operating voltage input pin via the third resistor and the second ESD protection circuit in series, and the first switching unit being connected in parallel with the third resistor.

10. The LCD as claimed in claim 9, wherein the second voltage change circuit comprises:

a fourth resistor connected between the second reference voltage pin and the second voltage following pin; and a fifth resistor connected between the first voltage following pin and the operating voltage input pin.

11. The LCD as claimed in claim 10, wherein the fourth resistor comprises a fuse part configured to melt when a high level ESD voltage is applied to the fourth resistor.

12. The LCD as claimed in claim 11, wherein the fourth resistor is made of indium tin oxide (ITO).

13. The LCD as claimed in claim 11, wherein the fourth resistor is made of indium zinc oxide (IZO).

14. The LCD as claimed in claim 10, wherein the second voltage change circuit further comprises a third ESD protection circuit connected to the second voltage following pin.

15. The LCD as claimed in claim 14, wherein the second voltage change circuit further comprises a second switching unit, a sixth resistor, and a fourth ESD protection circuit, the second reference voltage pin being connected to ground via the sixth resistor and the fourth ESD protection circuit in series, and the second switching unit being connected in parallel with the sixth resistor.

16. The LCD as claimed in claim 15, wherein a 5000V voltage is provided to the first and second reference voltage pins in a moment to melt the fuse parts of the first and fourth resistors when the LCD changes work mode from the normal mode to a special mode.

17. The LCD as claimed in claim 16, wherein the voltages at the first voltage following pin and the second voltage following pin are respectively equal to a low level voltage and a high level voltage when the LCD works in the special mode.

18. The LCD as claimed in claim 1, wherein the first voltage change circuits and the second voltage change circuits are formed on the glass substrate.

19. The LCD as claimed in claim 1, wherein the first voltage change circuits and the second voltage change circuits are comprised in the driving ICs.

20. A liquid crystal display (LCD), comprising:

a glass substrate comprising a display area;

a plurality of driving integrated circuits (ICs) configured for providing image signals to the display area, each driving IC comprising a plurality of first reference voltage pins, a plurality of second reference voltage pins, a plurality of first voltage following pins, a plurality of second voltage following pins, and an operating voltage input pin;

a plurality of first voltage change circuits respectively connected between the first reference voltage pins and the first voltage following pins, each first voltage change circuit configured for conducting a first reference voltage from the first reference voltage pin to the first voltage following pin, and configured to be burned by an external apparatus such that the first reference voltage is thereafter changed to a different first reference voltage by the first voltage change circuit;

a flexible printed circuit board (FPCB) connected to the glass substrate for providing operating voltages to the driving ICs.

* * * * *